United States Patent [19]

Munsterer

[11] 4,404,762

[45] Sep. 20, 1983

[54] SKI TRAIL RESURFACING APPARATUS

[76] Inventor: Gerald A. Munsterer, 390 State Hwy. No. 15 S., Wharton, N.J. 07885

[21] Appl. No.: 346,506

[22] Filed: Feb. 8, 1982

[51] Int. Cl.[3] ..... E01H 8/04

[52] U.S. Cl. ..... 37/219; 239/2 S

[58] Field of Search ..... 37/195, 197, 219; 239/25, DIG. 12, 8, DIG. 21, DIG. 22, DIG. 23

[56] References Cited

U.S. PATENT DOCUMENTS

| | | | |
|---|---|---|---|
| 2,391,048 | 12/1945 | Vose | 239/DIG. 21 |
| 2,789,804 | 4/1957 | Toulmin, Jr. | 37/197 |
| 4,050,169 | 9/1977 | Pasquier | 37/219 |

*Primary Examiner*—E. H. Eickholt

*Attorney, Agent, or Firm*—Bernard J. Murphy

[57] ABSTRACT

In the embodiment depicted, the apparatus comprises a snow-negotiable, or slidable platform upon which is mounted a blower and an engine for powering of the latter. Flexible ducts are replaceably coupled to the inlet and outlet apertures of the blower, for ingesting snow thereinto, and for discharging snow therefrom. The outermost end of the first-mentioned duct has a toothed scarifier, projecting therefrom, for fragmenting accretions of snow. The apparatus is towed to adjacency to a bared ski trail area, and snow is displaced from adjacent environs and deposited onto the bared area; the first duct harvests the snow, conducts it to the blower, and the latter discharges the harvested snow, via the second duct, to the trail area which is in need of resurfacing.

6 Claims, 7 Drawing Figures

SKI TRAIL RESURFACING APPARATUS

This invention pertains to sporting apparatus and equipment, and in particular to apparatus for resurfacing bared ski trail areas.

Ski trails, which suffer a number of bared areas, or highly glazed areas, and stand in need for resurfacing, are typically resurfaced by snow-making machines in place at the bottom of the slope or trail. This is not unacceptable, but it is expensive, as it requires the use of engines, air compressors, piping, and water. Commonly, immediately adjacent to the bared or glazed areas of a trail, in wooded sections or sections with underbrush, are great accretions of undisturbed snow. What has been needed, is an apparatus of inexpensive and uncomplicated structure which can be transported to such areas and sections and move the snow, from the undisturbed accretions thereof, to the trail areas which need the resurfacing. It is an object of this invention to set forth just such a transportable, inexpensive, and uncomplicated apparatus.

Particularly is it an object of this invention to set forth a ski trail resurfacing apparatus comprising first means defining a blower; said first means having means for admitting a mixture of snow and air thereinto, and means for discharging a mixture of snow and air therefrom; first duct means in fluid-flow communication with said admitting means; and second duct means in fluid-flow communication with said discharging means; wherein said first duct means comprises a first, flexible duct having one end thereof opening into said admitting means; said second duct means comprises a second duct having one end thereof opening into said discharging means; and said first, flexible duct has means, on the end thereof which is opposite said one end, for manually gripping and manipulating and orienting said opposite end.

Further objects of this invention, as well as the novel features thereof, will become more apparent by reference to the following description, taken in conjunction with the accompanying figures, in which.

Figure 7:
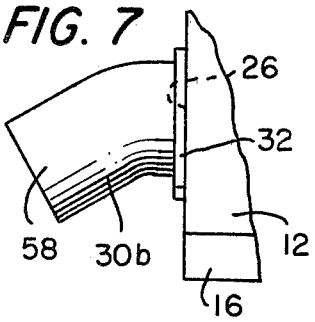
FIG. 7 is a side elevational view of a further alternative embodiment of the discharging duct.
Figure 3:
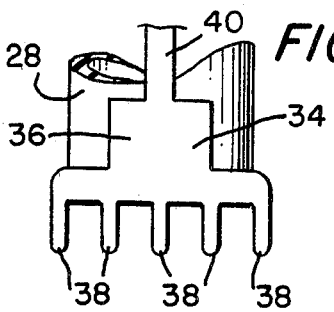
FIG. 3 is a plan view of the scarifying and of the ingesting duct, taken along 3—3 of FIG. 2.

As shown in the figures, the novel ski trail resurfacing apparatus 10, according to an embodiment thereof, comprises a skid 12 having an up-turned leading end and trailing end 14 and 16, respectively. The leading end of the skid has a towing eye 18 fixed thereto. Mounted upon the skid 12 are a blower 20 and a blower-powering engine 22, the latter two components being shown only in simple outline configuration.

The blower 20 has an inlet aperture 24, and a first outlet aperture 26, and ducts 28 and 30 coupled thereto, respectively. Ends of the ducts 28 and 30 are secured to the blower 20 (about annuluses, not shown) by means of clamps 32. Duct 28 is provided for ingesting air and snow, and duct 30 is provided for discharging air and snow.

The outermost end of duct 28 has a scarifier 34 fixed thereto. The latter comprises a plate 36 which partially enshrouds the upper surface of the duct end, and which is fixed thereto by fasteners (not shown). A plurality of teeth 38 project from the plate 36, in traverse of the open end of the duct 28, and outwardly therefrom at an angle. Integral with the plate 36, and on a side thereof opposite the teeth 38, is a hand-grip 40 for manually gripping, manipulating and orienting the duct end. Within the duct end, and in traverse of the opening thereof, are a pair of spaced-apart rods 42. These define a baffle, to inhibit the ingestion, by duct 28, of large objects—such as limbs, frozen clumps of leaves, etc.

The other duct 30 also has, on its outermost end, a hand-grip 40 for its manipulation, the latter being integral with a terminating nozzle 44. By use of the latter hand-grip 40, the nozzle may be directed to where mixtures of air and snow are desired. In use, the apparatus 10 is towed by a powered vehicle, by means of its eye 18, up a ski trail or slope where resurfacing is needed. The apparatus is positioned adjacent to the resurfaceable area, and the engine 22 is started to power the blower 20. Then, two persons handle the ducts 28 and 30. One person moves out into adjacent areas and, by manipulating the outermost end of duct 28, harvests snow from accretions thereof. The latter person addresses the scarifier 34 to the accretions, to fragment the snow and allow it to be ingested by the duct 28 with air. The other person mans the nozzle 44 of duct 30, and directs discharging snow and air to bared or glazed areas of the ski trail.

What I have described thus far, of course, is only exemplary of the invention. Surely, the apparatus 10, in an alternative embodiment thereof, could be self-powered, the same comprising a powered snow-sled, or the like. Too, the outermost end of the duct 28 can be configured as a flat, widened mouth; the nozzle need not be of the conformation shown. In lieu of a skid 12, the platform could be a towed sled with runners. Also, the scarifier 34 can take many forms, as well as can the baffle defined by rods 42.

Figure 4:
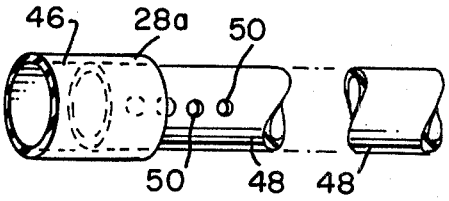
FIG. 4 is a fragmentary, discontinuous view of an alternative embodiment of the ingesting duct.
Figure 2:
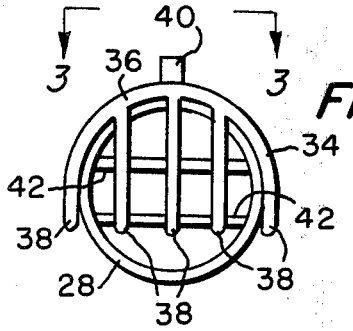
FIG. 2 is an end view of the scarifying end of the ingesting duct, taken along 2—2 of FIG. 1.
Figure 2:
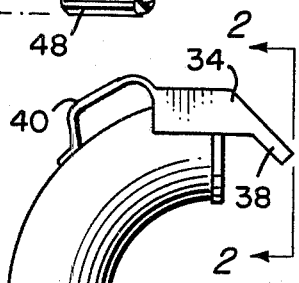

In an alternative embodiment, shown in FIG. 4, the ingesting duct **28*a* is formed of a plurality of ducts 46 and 48 which are slidably and mutually engaged, in that the relative inside diameter and outside diameter, respectively, define a frictional fit. Duct 48 has a series of breather holes 50 formed therein selectively to admit air to aid in the conduct of snow therethrough. By moving duct 48 into or out of duct 46**, the number of breather holes exposed may be controlled. The number of holes to be exposed depends upon the consistency of the snow, its moisture content, etc.

Figure 5:
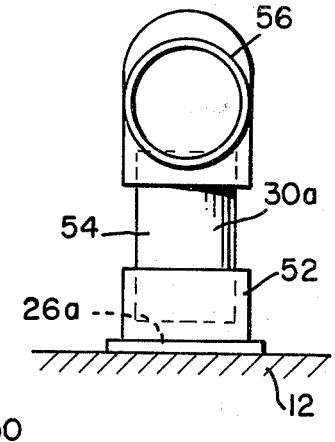
FIG. 5 is a front elevational view of an alternative embodiment of the discharging duct.
Figure 1:
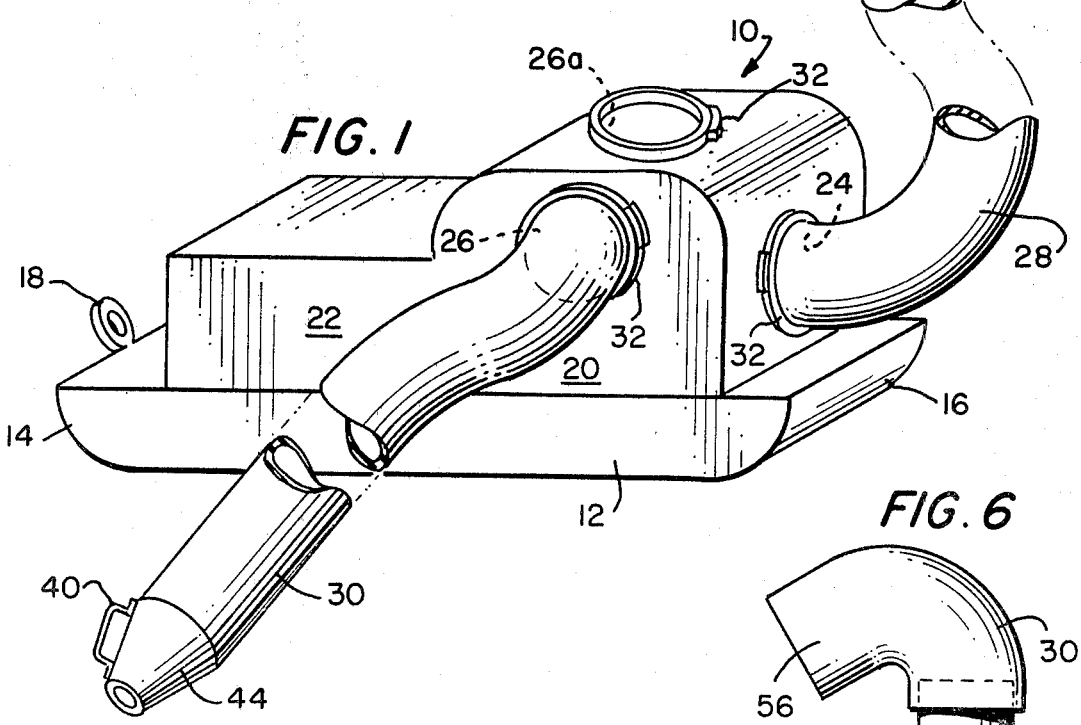
FIG. 1 is an isometric projection of an embodiment of the invention.
Figure 6:
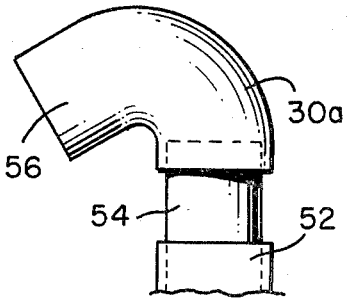
FIG. 6 is a side elevational view of the duct of FIG. 5.

FIGS. 5 and 6 depict an alternative discharging duct **30*a*. The blower housing 20, as shown in FIG. 1, has a second outlet aperture 26*a* formed in the top surface thereof to which the duct 30*a* may be replaceably mounted by means of a clamp 32. Duct 30*a* comprises a plurality of interfitting conduits 52, 54 and 56. The first thereof is received by the clamp 32, and the second defines a journal for the third. Conduit 56 is substantially an elbow and, by selective rotation thereof on the journalling conduit 54, can be directed through a full circle. Thus, when the discharge orientation of duct 30*a*** is set, it requires no further manipulation.

Another alternative discharging duct 30*b* is shown in FIG. 7. This embodiment comprises a simple, unitary conduit 58 held by a clamp 32 to the first outlet aperture 26—in lieu of the flexible duct 30. Of course, by adjustment with the clamp 32, this further duct 30*b*, defining a shallow angle, can be directed to discharge snow and air slightly forwardly, rearwardly, upwardly and downwardly. Again, when its orientation is set, it requires no handling.

While I have described my invention in connection with specific embodiments thereof, it is to be clearly understood that this is done only by way of example, and not as a limitation to the scope of my invention as set forth in the objects thereof and in the appended claims. The apparatus 10, for instance, could be mounted upon a snow vehicle to accommodate its transport. Besides resurfacing ski trails, the apparatus 10 can also be used for stockpiling snow, in a convenient location, for subsequent spreading and patching. As noted, the apparatus has a plurality of outlets 26 and 26*a;* patently, either or both can be put to use, as required—for large area spreading of snow, or for simple spot patching. All such alternative embodiments and uses are deemed to be within the ambit of my invention and comprised by the appendant claims.

I claim:

1. Ski trail resurfacing apparatus, comprising:

first means defining a blower;

said first means having means for admitting a mixture of snow and air thereinto, and means for discharging a mixture of snow and air therefrom;

first duct means in fluid-flow communication with said admitting means; and second duct means in fluid-flow communication with said discharging means; wherein said first duct means comprises a flexible duct having one end thereof opening into said admitting means;

said second duct means comprises a second duct having one end thereof opening into said discharging means;

said first duct has means, on the end thereof which is opposite said one end, for manually gripping said opposite end, said manipulating and orienting said first duct and said opposite end;

said first duct further has, on said opposite end thereof, means for scarifying accretions of snow, and baffle means, in said opposite end thereof, for inhibiting the ingestion of large objects;

said scarifying means comprises means defining a plurality of depending teeth, immovably fixed to, and which extend in partial traverse of, said opposite end, and at an angle outwardly therefrom; and said baffle means comprises a plurality of linear elements bridging across said opposite end, in substantial parallelism, and transverse to said teeth.

2. Ski trail resurfacing apparatus, according to claim 1, wherein:

said first means includes a prime mover operative of said blower.

3. Ski trail resurfacing apparatus, according to claim 1, wherein:

said discharging means comprises a plurality of snow and air discharging apertures.

4. Ski trail resurfacing apparatus, according to claim 1, wherein:

said first duct means includes a plurality of frictionally and slidably engaged ducts, in concentric, telescoping disposition; and one of said slidably engaged ducts has a plurality of breather holes formed therein.

5. Ski trail resurfacing apparatus, according to claim 1, wherein:

said second duct means includes a duct having a substantially elbow configuration, and a duct upon which said elbow-configured duct is journalled.

6. Ski trail resurfacing apparatus, according to claim 3, wherein:

said second duct comprises a single, unitary conduit fixed in place over one of said apertures.

* * * * *

UNITED STATES PATENT AND TRADEMARK OFFICE

CERTIFICATE OF CORRECTION

PATENT NO. : 4,404,762

DATED : Sep. 20, 1983

INVENTOR(S) : Gerald A. Munsterer

It is certified that error appears in the above—identified patent and that said Letters Patent is hereby corrected as shown below:

In column 4, line 3, "said manipulating" should read — and manipulating — .

Signed and Sealed this

*Twenty-seventh* Day of *December 1983*

[SEAL]

*Attest:*

GERALD J. MOSSINGHOFF

*Attesting Officer*

*Commissioner of Patents and Trademarks*